United States Patent [19]

Ims

[11] Patent Number: 4,545,735

[45] Date of Patent: Oct. 8, 1985

[54] DIAPHRAGM PUMP HAVING A VALVE SHEET WITH INLET AND OUTLET FLAPS AND HAVING ANTISIPHONING CAPABILITY DURING PUMP SHUTDOWN

[75] Inventor: Horst O. H. Ims, Waterloo, Canada

[73] Assignee: Uniroyal, Ltd., Don Mills, Canada

[21] Appl. No.: 642,290

[22] Filed: Aug. 17, 1984

[51] Int. Cl.[4] ..... F04B 49/00; F04B 21/02; F16K 24/00

[52] U.S. Cl. ..... 417/307; 417/413; 417/560; 417/566; 137/215; 222/383; 92/82

[58] Field of Search ..... 417/413, 307, 311, 560, 417/566, 571, 296, 297, 299; 137/143, 147, 148, 215; 92/82; 222/383

[56] References Cited

U.S. PATENT DOCUMENTS

| | | | |
|---|---|---|---|
| 862,867 | 8/1907 | Eggleston | 417/390 |
| 1,419,273 | 6/1922 | La Bour | 137/143 |
| 2,797,131 | 6/1957 | Parkes | 417/571 X |
| 2,918,878 | 12/1959 | Zieg et al. | 417/566 X |
| 2,927,595 | 3/1960 | Braaten | 137/143 X |
| 3,179,055 | 4/1965 | Kalert, Jr. | 417/566 X |
| 3,430,813 | 3/1969 | Gilmont | 222/383 X |
| 3,483,884 | 12/1969 | Sullivan | 137/215 |
| 3,771,907 | 11/1973 | Neumann et al. | 417/454 |
| 3,930,516 | 1/1976 | Flinner et al. | 137/215 |
| 3,941,519 | 3/1976 | McCauley | 417/560 |
| 4,035,107 | 7/1977 | Kesten et al. | 417/311 X |
| 4,086,037 | 4/1978 | Stewart | 417/571 |
| 4,167,896 | 9/1979 | Clements | 92/13.4 X |
| 4,370,102 | 1/1983 | Sasaki et al. | 417/296 |

FOREIGN PATENT DOCUMENTS

| | | | |
|---|---|---|---|
| 1428007 | 12/1968 | Fed. Rep. of Germany | 417/566 |

*Primary Examiner*—William L. Freeh
*Assistant Examiner*—Paul F. Neils
*Attorney, Agent, or Firm*—Jack Posin

[57] ABSTRACT

The pump has a pumping chamber with a deflectable diaphragm member and fluid inlet and outlet passages. A deflectable valve flap is disposed across the fluid inlet passage and another flexible valve flap is disposed across the fluid outlet passage. Movement of the flexible valve flaps is responsive to movement of the flexible diaphragm member, reciprocation of which establishes alternate sequential suction and discharge conditions. An air chamber provided in the pump receives outside air through an air vent opening and also communicates with the pump discharge passage through a bleed hole when the outlet passage is closed by the outlet valve flap. The outlet valve flap is also deflectable to a position where it closes the bleed hole. Under this arrangement, continuous siphoning of fluid through the pump after the pump has been shut down is obviated. In the event that an obstruction occurs at the discharge section of the pump the outlet valve flap will move to a position intermediate the outlet passage and the bleed hole thereby permitting discharged fluid to bypass the discharge section of the pump and return to an inlet supply portion of the pump.

14 Claims, 7 Drawing Figures

10
40
42
44
46
50
58
60
62
64
66
68
70
72
74
76
77
78
80
82
94
96
100

DIAPHRAGM PUMP HAVING A VALVE SHEET WITH INLET AND OUTLET FLAPS AND HAVING ANTISIPHONING CAPABILITY DURING PUMP SHUTDOWN

BACKGROUND OF THE INVENTION

This invention relates to pumps, and more particularly to a pump having an anti-siphoning capability when the pump is turned off.

Pumps for transferring fluids, such as liquids, from one location to another are well known. The operation of most known pumps is usually based on the development of a suction condition in the pump to draw liquid therein and a sequential pressure condition to expel the liquid from the pump. During normal pumping operations the suction and pressure conditions often produce a siphoning effect which aids the pumping action.

However when a pump is turned off, after a siphoning condition has developed, fluid transfer through the pump may undesirably continue by virtue of the siphoning condition rather than any pumping action. This continuous siphoning after pump shutdown is generally undesirable.

On numerous occasions the fluid that is subject to a pumping operation is expensive and is usually wasted if continuous siphoning of such fluid through the pump occurs after the pump is shut down, a condition hereinafter referred to as continuous siphoning. In addition, certain fluids operated on by a pump are noxious, toxic or otherwise dangerous, and if permitted to run off due to continuous siphoning can cause undesirable contamination or pollution, in addition to an expensive cleanup problem.

In certain instances fluids that are continuously siphoned through a pump after a pump is shut down are provided with special entrapment or catch containers that occasionally overflow. Thus, the problem of uncontrolled fluid runoff due to continuous siphoning is not easily solved when transferred from one state of a pumping operation to another.

Fluid runoff from pumps, due to continuous siphoning, has long been a problem with small acreage farmers who may be financially dependent upon inexpensive pumps that are subject to continuous siphoning. The farmer often uses a pump for seed treatment wherein chemicals are added to the seed as the seed is planted. In large scale farming operations and in seed treatment plants, highly specialized equipment is capable of processing numerous tons of seed with substantial amounts of chemicals on a daily basis.

High volume systems for seed treatment generally include sophisticated and intricate control systems with an array of valves that precisely control chemical additives. Such systems are usually beyond the financial reach of the small acreage farmer.

One method of dealing with the problem of continuous pump siphoning, is disclosed in U.S. Pat. No. 2,918,878. The disclosed pump includes a bleeder valve that permits air to enter the pump to prevent continuous siphoning of fluid when the pump is shut down. However the bleeder valve must be manually positioned at the end of a pumping operation. In addition, the bleeder valve must be manually adjusted to a closed position when continuous siphoning stops or the pump will not function at its optimum level when restarted. The need for manual adjustment of the bleeder valve is a problem because the pump operation must be monitored and thus labor costs are added to the operation of the pump.

U.S. Pat. No. 1,419,273 discloses a pump with a float controlled air vent for purposes of preventing continuous siphoning. This arrangement does not provide precise shutoff control since the float must recede to a predetermined level before the air vent opens. Under the disclosed air vent arrangement, it is possible for significant amounts of liquid to flow through an outlet faucet after the pump is shut down and before the air vent opens.

In addition to continuous siphoning, another problem associated with pumps of the type described is the possibility of damage to the pump when the pump discharge is blocked or otherwise obstructed. If a pump continues to operate while an obstruction prevents discharge of fluid, the pump may stall and become damaged.

It is thus desirable to provide a pump with an anti-siphoning capability that operates automatically to provide a precise shutoff and reroutes pumped fluid away from an obstructed outlet to prevent pump damage.

OBJECTS AND SUMMARY OF THE INVENTION

Among the several objects of the invention may be noted the provision of a novel pump, a novel pump that does not continue to siphon fluid after the pump is turned off, a novel pump that has flexible deflectable inlet and outlet valves, a novel pump with a novel air vent and air bleeder arrangement, and a novel pump that reroutes fluid away from the pump discharge when the discharge portion is blocked or otherwise obstructed.

Other objects and features of the invention will be in part apparent and in part pointed out hereinafter.

In accordance with the present invention a pump is provided with a pumping chamber, a fluid inlet that directs fluid into the pumping chamber and a fluid outlet that directs fluid out of the pumping chamber. The pumping chamber includes a flexible diaphragm deflectable in a first direction when fluid intake is occurring and deflectable in a second direction, generally opposite the first direction, when fluid discharge is occurring.

The diaphragm is moved back and forth by a reciprocating drive that exerts a push-pull action on the diaphragm which causes suction and pressure cycles to alternate within the pump chamber.

The pump is also provided with valve sheet that include a flexible inlet valve disposed across the fluid inlet portion and a flexible outlet valve disposed across the fluid outlet portion. During fluid intake the fluid inlet valve deflects to an open position and the fluid outlet valve deflects to a closed position. During fluid discharge the fluid inlet valve is deflected into a closed position and the fluid outlet valve is deflected into an open position.

The deflectable inlet and outlet valves are formed as flaps in the valve sheet.

The pump also includes an air chamber having venting means for venting the air chamber to the outside of the pump. In addition a bleed hole is provided for permitting communication between the fluid outlet passage and the air chamber. Such communication occurs when the outlet valve is in a closed position. When the outlet valve is in a fully open position it closes the bleed hole.

During conditions where the discharge passage of the pump is blocked or otherwise obstructed, the outlet valve, due to a buildup of back pressure, is permitted to move to a position intermediate its open and closed positions. Accordingly the fluid outlet passage communicates with the air chamber, as well as the pump chamber. Thus fluid that is pumped into the pump chamber and cannot be discharged is permitted to flow through the bleed hole and air chamber back to a supply source which is provided below the air chamber.

The pump also includes an anti-siphoning capability by virtue of the arrangement of the air vent and the bleed hole. For example, in the absence of the bleed hole a continuous siphoning condition would occur in the pump when the pump is shut down. However, the bleed hole permits outside air to enter the fluid outlet passage of the pump by passing through the air vent hole and into the air chamber of the pump which communicates with the bleed hole. The air vent and bleed hole thus permit an equalization of pressure to occur inside and outside the pump chamber after the pump is shut off. The problem of continuous siphoning is thus obviated.

The invention accordingly comprises the constructions hereinafter described, the scope of the invention being indicated in the claims.

DESCRIPTION OF THE DRAWINGS

In the accompanying drawings in which one embodiment of the invention is illustrated.

FIG. 6 is a view similar to FIG. 5 showing the fluid discharge stage; and

Corresponding reference characters indicate corresponding parts in the several views of the drawings.

DETAILED DESCRIPTION OF THE INVENTION

Figure 1:
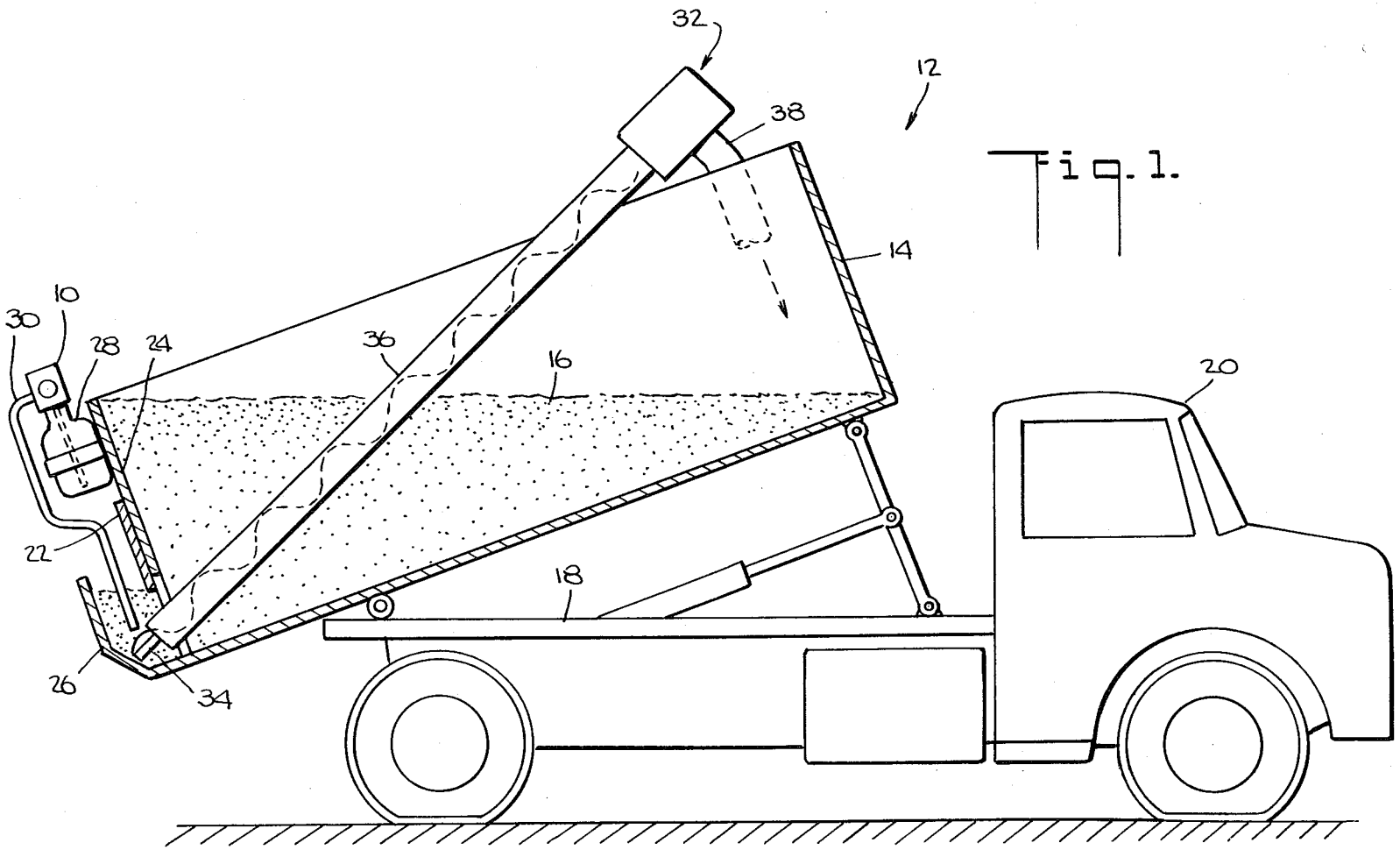
FIG. 1 is a simplified schematic view of a seed treatment system employing a pump that incorporates one embodiment of the invention.

A pump incorporating a preferred embodiment of the invention is generally indicated by the reference number 10 in FIG. 1.

The pump 10, although having a diversity of application, is disclosed herein for use with a portable seed treatment system 12. The seed treatment system 12 includes a seed bin 14 for holding seed 16, pivotally mounted to the bed portion 18 of a truck 20.

A sliding gate 22 is provided at an end wall 24 of the seed bin 14 to release the seed 16 into a collection trough 26 that extends beyond the end wall 24. The end wall 24 also supports a container 28 of seed treatment chemical that detachably connects to the pump 10. A pump delivery duct 30 extends from the pump 10 into the collection trough 26.

An auger assembly mounted over the seed bin 14 includes an auger member 34 in an inlet duct 36 that communicates with an outlet duct 38.

Figure 2:
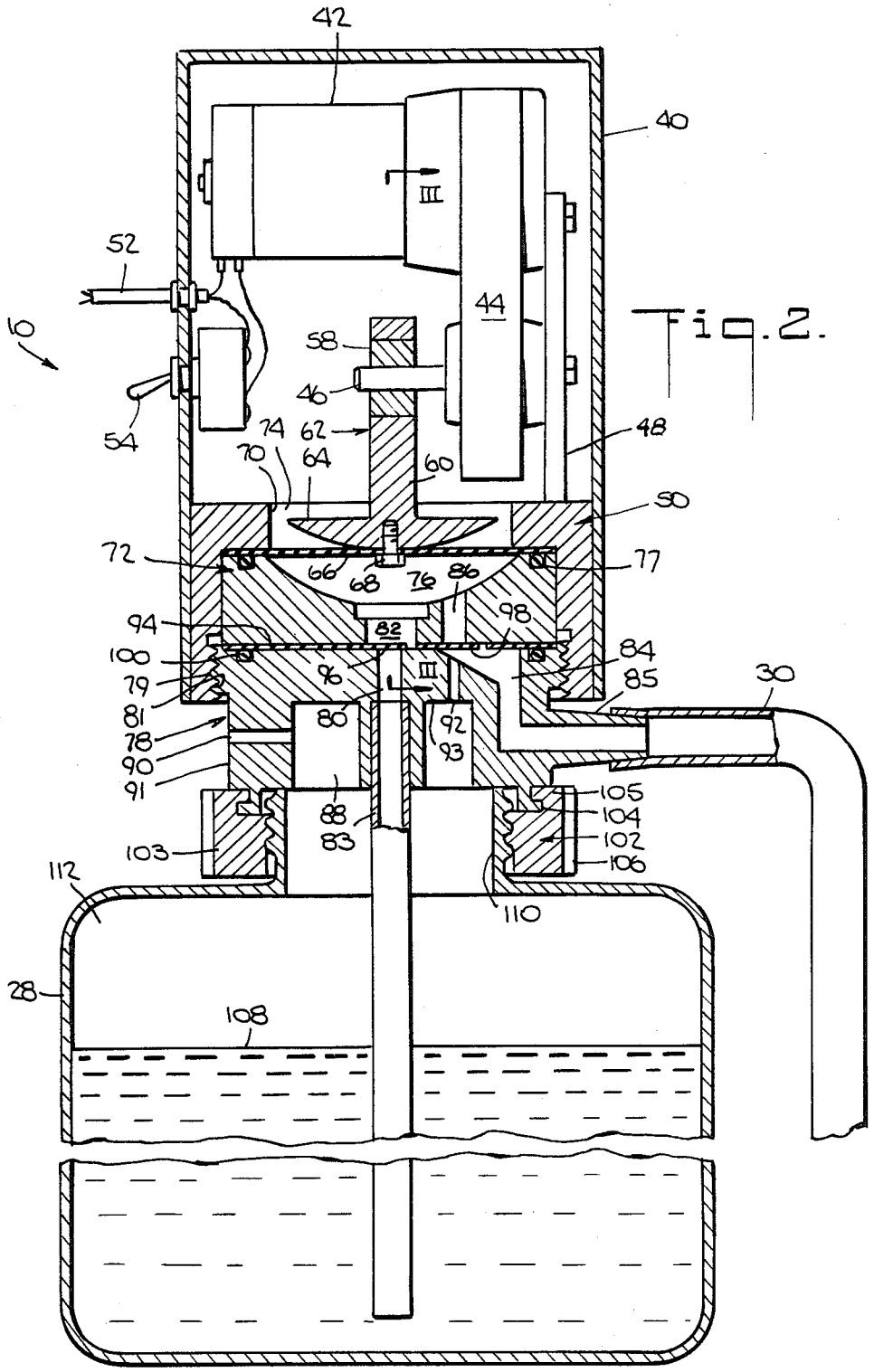
FIG. 2 is a sectional view of the pump.

Referring to FIG. 2, the pump 10 includes a housing 40 containing a motor 42 with a speed reducer assembly 44 having an output shaft 46. The motor 42 and speed reducer assembly 44 are supported on an extension 48 of an annular frame 50. The housing 40 and the annular frame 50 are joined together by fasteners (not shown) or other suitable known affixation arrangement. Alternatively, housing 40, extension 48 and frame 50 could comprise a single, integral molded part.

Power is furnished to the motor 42 by the truck battery (not shown) through a cable 52. A switch 54, secured to the housing 40, controls operation of the motor 42.

The output shaft 46 is keyed or otherwise locked off center to an eccentric member 58. The eccentric member 58 is rotatable in a leg portion 60 of a crank member 62 having an enlarged convex head portion 64.

A flexible diaphragm member 66 is secured to the convex head portion 64 of the crank member 62 by a cap screw 68. The diaphragm member 66 is formed of any suitable elastomeric material that is not deleteriously affected by the fluids intended to be used with the pump 10. The diaphragm member 66 is sandwiched between an annular flange 70 of the frame 50 and a chamber member 72. The annular flange 70 thus defines a recess 74 for accommodating the convex head portion 64 of the crank member 62.

A concave pump chamber recess 76 is formed in the chamber member 72 in alignment with the recess 74. An O-ring 77 disposed between the chamber member 72 and the diaphragm member 66 helps provide a leak-tight seal around the pump chamber 76.

A fluid passage member 78 having external threads 79 is threaded to internal threads 81 of the annular frame 50 to abut against the chamber member 72. A fluid inlet passage 80 is formed in a central portion of the fluid passage member 78 in alignment with an inlet extension 82 of the pump chamber 76. An inlet tube 83 is accommodated in an end of the inlet passage 80 and forms an extension of the inlet passage 80.

A fluid outlet passage 84 is formed in a radially outward portion of the fluid passage member 78 such that a portion of the outlet passage 84 aligns with an outlet extension 86 of the pump chamber 76. A spigot portion 85 of the outlet passage 84 connects to the delivery duct 30.

The fluid passage member 78 also includes an air space 88 defined by an annular recess formed between the inlet passage 80 and the outlet passage 84. An air vent opening 90 in a peripheral wall 91 of the fluid passage member 78 provides communication between the air space 88 and the air outside the pump 10. A bleed hole 92 is formed in a lateral portion 93 of the fluid passage member 78 in a lignment with the outlet extension 86 of the pump chamber 76. The bleed hole 92 permits communication between the outlet passage 84 and the air space 88.

Valve means for the pump include an elastomeric sheet member 94 sandwiched between the chamber member 72 and the fluid passage member 78. The sheet member 94 is formed with a deflectable flap 96 (FIG. 5) located between the fluid inlet passage 80 and the inlet extension 82 of the pump chamber 76.

Figure 5:
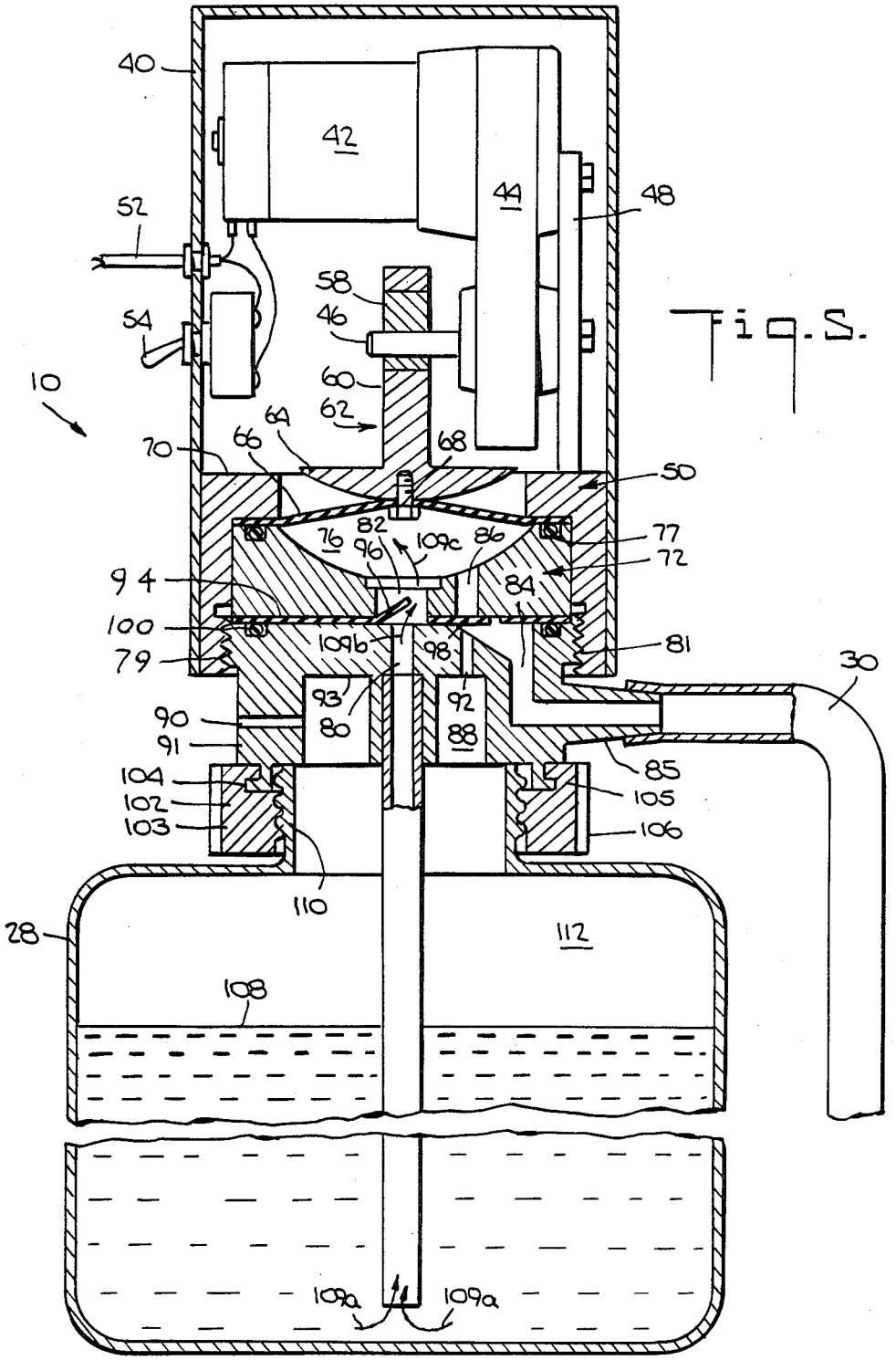
FIG. 5 is a view corresponding to FIG. 2 showing the fluid intake stage.
Figure 5:
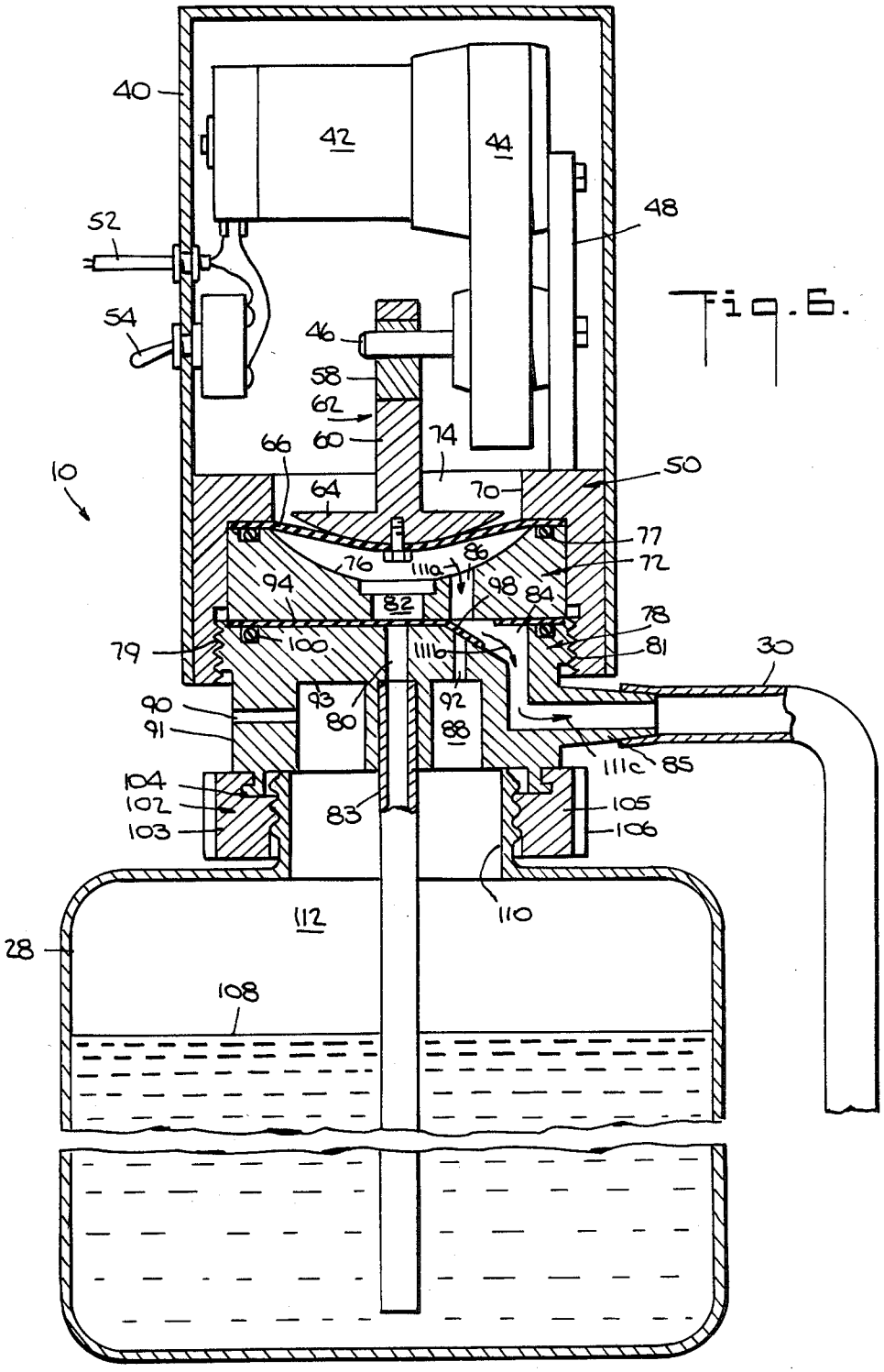

The flap 96 functions as an inlet valve. For example, the flap 96, in a non-deflected position covers and thereby closes the fluid inlet passage 80 preventing reverse flow from the pump chamber 76 to the inlet passage 80. The flap 96 is arranged to deflect into the inlet extension 82, as shown in FIG. 5, thereby opening the inlet passage 80 and permitting flow from the inlet passage 80 to the pump chamber 76.

The sheet member 94 is also formed with a deflectable flap 98 located between the fluid outlet passage 84 and the outlet extension 86 of the pump chamber 76. The flap 98 functions as an outlet valve, and, in a non-deflected position covers and closes the fluid outlet extension 86. Consequently, the non-deflected position of the flap 98 prevents reverse flow from the outlet passage 84 to the pump chamber 76.

The flap 98 is arranged to deflect into the outlet passage 84, as shown in FIG. 6, opening the outlet extension 86 and permitting flow from the pump chamber 76 to the outlet passage 84. The flap 98, when fully deflected, as shown in FIG. 6, covers the bleed hole 92 thereby preventing back flow from the outlet passage 84 to the air space 88.

The sheet member 94 is clamped in a predetermined position between the chamber member 72 and the fluid passage member 78 when the fluid passage member 78 is threaded into the annular frame 50. The fluid passage member 78 and the chamber member 72 are also oriented at a predetermined position relative to each other by means of at least two alignment pins (not shown) that extend from the fluid passage member 78 through the sheet member 94 and into the chamber member 72.

The alignment pins thus serve to locate the sheet member 94 as well as the chamber member 72 in predetermined positions. Accordingly, the fluid passage member 78, when threaded into the frame 50, forces the chamber member 72 against the annular flange 70 to provide a leak-tight seal between the chamber member 72 and the frame 50. An O-ring 100 provided between the sheet member 94 and the fluid passage member 78 helps to assure a leak-tight seal therebetween.

An internally threaded container support ring 102 is formed of two semicircular portions 103 and 105. The semicircular portions 103 and 105 are secured to an annular flange 104 of the fluid passage member 78 by a gripper ring 106 that embraces the semicircular portions 103 and 105 of the container support ring 102. The gripper ring 106 also facilitates rotation of the support ring 102. Preferably the support ring 102 is dimensioned such that it bears against the fluid passage member 78. If desired, an O-ring (not shown) can be provided between the support ring 102 and the fluid passage member 78.

The container 28, containing fluid such as seed treatment chemical 108, is secured to the support ring 102 by threading the support ring 102 around a complementary threaded neck portion 110 of the container 28.

Prior to using the pump 10, the seed bin 14 is tilted to the position shown in FIG. 1 and the sliding gate 22 is elevated to permit seed 16 to flow into the collection trough 26. Before the seed 16 is carried up to the inlet duct 36 by the auger member 34, it is treated with the chemical 108 that is dispensed into the seed trough 26 through the delivery duct 30. The seed treatment chemical 108 is pumped from the container 28 by the pump 10 and mixed thoroughly in the seed 16 by the mixing action of the auger 34 as the seed 16 moves through the inlet duct 36 to the outlet duct 38.

Figures 3, 4:
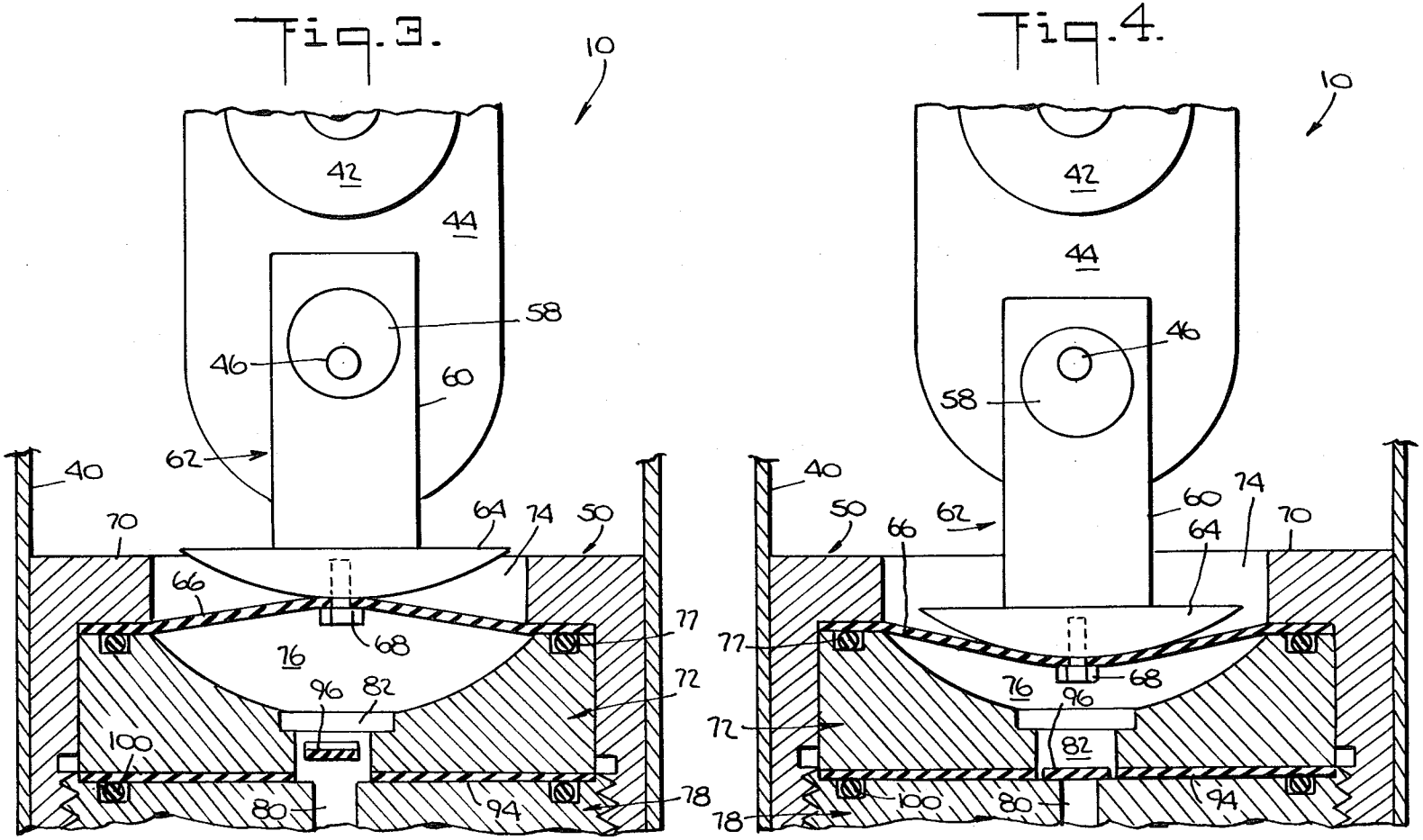
FIGS. 3 and 4 are enlarged fragmentary sectional views, taken along the line III—III of FIG. 2, showing two different stages of operation of the pump.

In operation of the pump 10 the switch 54 is turned on and the fluid 108 is drawn into the inlet tube 83 when the crank member 62 moves upwardly relative to FIG. 2 to the position shown in FIG. 3. Rotation of the output shaft 46 causes the eccentric member 58 to elevate the crank member 62 thereby pulling or deflecting the diaphragm member 66 in a direction that causes enlargement of the pump chamber 76.

It should be noted that the pump chamber 76 is understood to include the space enclosed by the diaphragm member 66. Enlargement of the pump chamber 76 establishes a suction or vacuum condition therein while an atmospheric condition is established above the fluid 108 due to the air chamber 88. This pressure difference causes the inlet valve flap 96 to deflect into the open position of FIG. 5 and enables the fluid 108 to flow from the container 28 into the pump chamber 76, as shown by the arrows 109*a*, 109*b* and 109*c*.

It should also be noted that the bleed hole 92, during the fluid intake stage of the pumping operation, permits the air space 88 to communicate with the fluid outlet passage 84. The combination of an atmospheric pressure condition in the fluid outlet passage 84 and a vacuum condition in the pump chamber 76 during fluid intake urges the outlet valve flap 98 against the chamber member 72. The outlet flap 98 thus closes the outlet extension 86 of the pump chamber 76 during fluid intake.

After the suction or fluid intake cycle is completed, further rotation of the output shaft 46 causes the eccentric member 58 to move the crank member 62 downwardly to the position shown in FIGS. 4 and 6. Downward movement of the crank member 62 pushes the diaphragm member 66 toward the fluid passage member 78 thereby increasing the pressure in the pump chamber 76.

The pressure increase in the pump chamber 76 causes the fluid 108 in the pump chamber to force the inlet valve flap 96 to deflect against and close the fluid inlet passage 80. When the pressure in the pump chamber 76 exceeds the atmospheric pressure present in the outlet passage 84, the outlet valve flap 98 deflects away from the outlet extension 86 of the pump chamber 76. The fluid 108 in the pump chamber 76 is thus discharged from the outlet extension 86 through the fluid outlet passage 84 into the delivery duct 30, as shown by the arrows 111*a*, 111*b* and 111*c*. During such discharge the outlet valve flap 98 covers or closes the bleed hole 92, as shown in FIG. 6.

The push-pull movement of the diaphragm member 66 in opposite directions thus establishes a one-way flow of fluid 108 through the inlet passage 80, the pump chamber 76 and the discharge passage 84 and causes a predetermined sequential opening and closing of the inlet and outlet valve flaps 96 and 98.

Referring to FIGS. 3 and 4, it will be noted that as the crank member 62 moves from the position of FIG. 3 to the position of FIG. 4 the convex head portion 64 tends to pivot about the cap screw 68 while it travels from an upper limit position as shown in FIG. 3 to a lower limit position as shown in FIG. 4. The pump chamber recess 76 in the chamber member 72 is thus sized to accommodate the pivoting movement of the convex head portion 64.

Since the bleed hole 92 is aligned with the outlet extension 86, the outlet valve flap 98 has two functions, namely to open and close the outlet extension 86 and also to open and close the bleed hole 92 in a predetermined sequence. The arrangement of the bleed hole 92 enables the pump 10 to prevent continuous siphoning of the fluid 108 when the switch 54 is turned off to shut down pump operation.

For example, assume the pump 10 is shut down after operation so that the inlet tube 83, delivery duct 30 and pump chamber 76 are filled with fluid, and that the end of the delivery duct 30 is at an elevation below that of the inlet tube 83. The difference in elevations of the fluid level in the container 28 and the fluid level at the lower end of the delivery duct 30 would, in the absence of the bleed hole 92, cause opening of both the inlet valve flap 96 and the outlet valve flap 98, and would result in a continuous flow of fluid from the delivery duct, due to siphoning action. Under these conditions, the fluid 108 would continuously flow out of the container 28 until the container 28 became empty.

Figure 7:
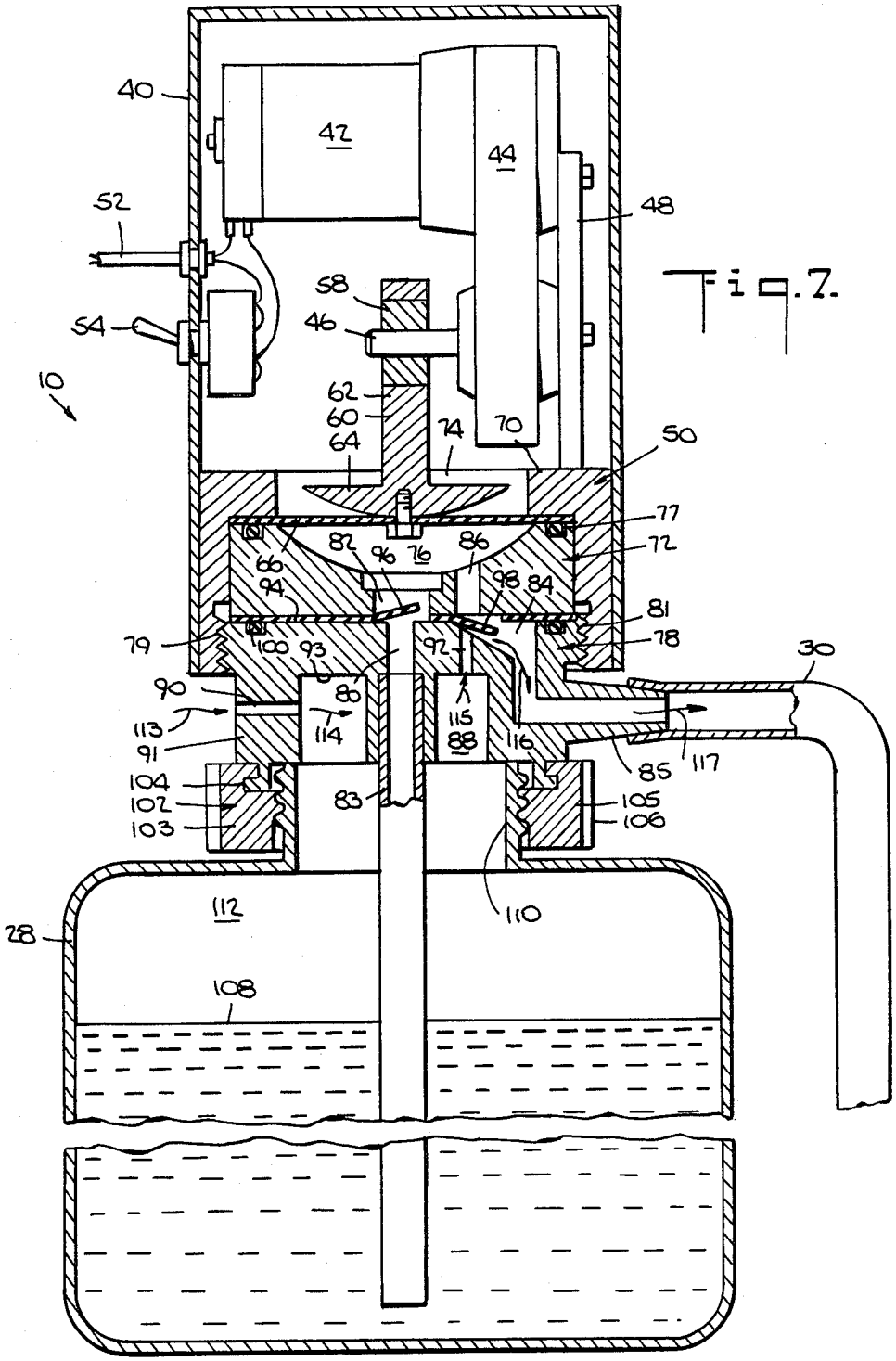
FIG. 7 is another view similar to FIG. 5 showing the anti-siphoning feature of the invention activated.

Provision of the bleed hole 92 prevents continuous siphoning by allowing atmospheric air to be drawn into the fluid outlet passage 84 and delivery duct 30 via the air vent 90, the air chamber 88 and the bleed hole 92, as shown by the arrows 113–117 in FIG. 7.

The air vent 90 vents the space 112 above the level of liquid 108 in the container 28 and the air chamber 88 which opens into the space 112. The air vent 90 thus prevents a vacuum condition from developing in the space 112 during the pumping operation. The air vent 90 also permits an equalization of pressure to occur inside and outside the pump chamber 76 after the pump 10 is shut off. The air vent 90 and the bleed hole 92 arrangement thus solves the problem of continuous siphoning in a pump.

Should the delivery duct 30 become kinked or otherwise obstructed, discharge of the fluid 108 from the pump 10 is blocked. In the absence of the bleed hole 92 a fluid pressure buildup will occur inside the pump chamber 76. As a consequence of such pressure buildup in the pump chamber 76, the diaphragm member 66 can rupture and the fluid-tight seals between the chamber member 72, the fluid pressure member 78 and the annular frame 50 can break. Damage can also occur to the delivery duct 30.

The presence of the bleed hole 92 obviates the likelihood of such damage. For example, if a discharge obstruction develops, a back pressure will build up in the oulet passage 84. As the back pressure in the outlet passage 84 approaches equality with the pressure in the pump chamber 76, the pressure on both sides of the outlet valve flap 98 equalizes and there is no longer a sufficient pressure differential to force the outlet valve flap 98 against the bleed hole 92.

The outlet valve flap 98 will thus assume a position intermediate the bleed hole 92 and the outlet extension 86, such as that shown in FIG. 7. The fluid 108 that cannot be discharged through the delivery duct 32 now has an alternate flow path from the pump chamber 76 into the container 28 through the bleed hole 92. The bleed hole 92 thus provides a return path for the fluid 108 from the fluid outlet passage 84 to the inside of the container 28.

The pressure buildup in the pump chamber 76 and in the fluid outlet passage 84, which permits movement of the outlet valve flap 98 to the intermediate position of FIG. 7, is a predetermined pressure level that does not cause damage to the pump 10.

Some advantages of the present invention evident from the foregoing description include the provision of a novel inexpensive pump with a bypass from the pump outlet to the pump supply in the event that a discharge obstruction occurs, and a pump with a novel venting arrangement that prevents continuous siphoning when the pump is shut down.

In view of the above, it will be seen that the several objects of the invention are achieved and other advantageous results attained.

As various changes can be made in the above construction without departing from the scope of the invention, it is intended that all matter contained in the above description or shown in the accompanying drawings shall be interpreted as illustrative and not in a limiting sense.

What is claimed is:

1. A pump for use with a fluid reservoir container, said pump comprising, a pumping chamber, fluid intake means for directing fluid into said pumping chamber, fluid discharge means for directing fluid out of said pumping chamber, flexible diaphragm means at said pumping chamber deflectable in a first direction to draw fluid through said fluid intake means into said pumping chamber and deflectable in a second direction to expel fluid from said pumping chamber through said fluid discharge means, reciprocating means communicable with said diaphragm means for moving said diaphragm means in said first and second directions, an inlet valve disposed across said fluid intake means and an outlet valve disposed across said fluid discharge means, an air chamber in said pump in communication with the fluid in said container and having vent means for venting said air chamber at the atmosphere, a bleed hole for permitting communication between said fluid discharge means and said air chamber, said inlet and outlet valves being deflectable such that movement of said flexible diaphragm means in said first direction causes movement of said inlet valve to a fully open position to permit drawing of fluid into said pumping chamber and movement of said outlet valve to a fully closed position to prevent reverse flow from said fluid discharge means to said pumping chamber, and movement of said flexible diaphragm means in said second direction causes movement of said inlet valve to a fully closed position to prevent reverse flow of said fluid from said pumping chamber back to said fluid intake means and, during normal operation of the pump with the fluid discharge means in an unblocked condition, causes movement of said outlet valve to a fully open position to permit discharge of fluid from said pumping chamber to said fluid discharge means, said outlet valve in said fully open position closing said bleed hole and interrupting communication between said fluid discharge means and said air chamber.

2. The pump as claimed in claim 1, wherein upon blockage of fluid flow downstream of said fluid discharge means, said outlet valve is moveable to a position intermediate the fully open and fully closed positions of said outlet valve to permit communication between said fluid discharge means and said air chamber while said fluid discharge means communicates with said pumping chamber whereby fluid pumped from said pumping chamber into said fluid discharge means is permitted to flow through said bleed hole into said air chamber.

3. The pump as claimed in claim 1, wherein said reciprocating means include a crankshaft connected to said diaphragm means.

4. The pump as claimed in claim 3, wherein said reciprocating means further include drive means and means for eccentrically joining said drive means to said crankshaft.

5. The pump as claimed in claim 1, wherein an elastomeric sheet is placed across said fluid intake means and said fluid discharge means and said inlet and outlet valves are formed as deflectable flaps in said elastomeric sheet.

6. The pump as claimed in claim 5, wherein said fluid inlet means includes a fluid inlet port, said inlet valve being disposed upon said fluid inlet port when said inlet valve is in said fully closed position and said fluid outlet valve being disposed against said outlet port when said outlet valve is in said fully closed position.

7. The pump as claimed in claim 6, wherein said inlet valve deflects in a first direction when it opens and said outlet valve deflects in a second direction opposite said first direction when said outlet valve opens.

8. A pump for use with a fluid reservoir container, said pump comprising, a pumping chamber, fluid intake means for directing fluid from said container into said pumping chamber, fluid discharge means for directing fluid out of said pumping chamber, flexible diaphragm means at said pumping chamber deflectable in a first direction and in a second direction opposite said first direction such that deflection of said diaphragm means in said first direction draws fluid through said fluid intake means into said pumping chamber and deflection of said diaphragm means in said second direction expels fluid from said pumping chamber through said fluid discharge means, reciprocating means communicable with said diaphragm means for moving said diaphragm means in said first and second directions, and valve means comprising a substantially planar flexible sheet disposed across said fluid intake means and said fluid discharge means, said valve means including a deflectable flexible inlet valve comprising a first movable flap integral with said sheet and disposed across said fluid intake means, said flap having an open position for permitting flow of fluid from said fluid intake means to said pumping chamber and a closed position for preventing reverse flow of fluid from said pumping chamber to said fluid intake means, said valve means further including an outlet valve comprising a second movable flap integral with said sheet and disposed across said fluid discharge means, said flap having an open position for permitting flow of fluid from said pumping chamber to said fluid discharge means and a closed position for preventing reverse flow of fluid from said fluid discharge means to said pumping chamber, said inlet valve and said outlet valve being arranged such that movement of said diaphragm means in said first direction causes said inlet valve flap to deflect toward said open position and said outlet valve flap to move toward said closed position, and movement of said diaphragm means in said second direction causes said inlet valve flap to deflect toward said closed position and said outlet valve flap to move toward said open position, said pump further including an air chamber therein in communication with the fluid in said container and having vent means for venting said air chamber to atmosphere, and including a bleed hole for permitting communication between said fluid discharge means and said air chamber when said outlet valve flap is in said closed position, said outlet valve flap having a fully open position wherein it covers said bleed hole and blocks communication between said fluid discharge means and said air chamber.

9. The pump as claimed in claim 8, wherein said fluid intake means and said fluid discharge means comprise respective passageways defined in a common structural member.

10. The pump as claimed in claim 8, wherein said diaphragm means is disposed at said pumping chamber such that deflection of said diaphragm means in said first direction increases the volume of said pumping chamber and deflection of said diaphragm means in said second direction decreases the volume of said pumping chamber.

11. The pump as claimed in claim 8, wherein said outlet valve flap is movable to a position intermediate the open and closed positions of said outlet valve flap to permit communication between said fluid discharge means and said air chamber while said fluid discharge means communicates with said pumping chamber, whereby fluid pumped from said pumping chamber into said fluid discharge means is permitted to flow through said bleed hole into said air chamber.

12. The pump as claimed in claim 8, wherein said reciprocating means include a crankshaft connected to said diaphragm means.

13. The pump as claimed in claim 12, wherein said reciprocating means further include drive means and means for eccentrically joining said drive means to said crankshaft.

14. A pump for use with a fluid reservoir container, said pump comprising a frame, a chamber member secured to said frame, said chamber member having a recess, a diaphragm disposed across said recess intermediate said frame and said chamber member to define a pumping chamber therebetween, a fluid passage member secured to said frame adjacent said chamber member and defining a fluid inlet passage and a fluid outlet passage therein, said inlet and outlet passages being communicable with said pumping chamber, an inlet valve provided between said fluid inlet passage and said pumping chamber, an outlet valve provided between said fluid outlet passage and said pumping chamber, an elastomeric sheet disposed between said chamber member and said fluid passage member, said inlet valve and said outlet valve comprising respective deflectable flaps integral with said elastomeric sheet, said fluid passage member including an air chamber therein in communication with the fluid in said container and venting means for venting said air chamber to atmosphere, said fluid passage member including a bleed hole for permitting communication between said fluid outlet passage and said air chamber, said outlet valve flap, when deflected to its fully open position, closing said bleed hole and interrupting communication between said fluid outlet passage and said air chamber.

* * * * *